United States Patent [19]

Wettlén

[11] Patent Number: 4,653,667

[45] Date of Patent: Mar. 31, 1987

[54] APPARATUS FOR DISPENSING TICKETS OR THE LIKE

[75] Inventor: Roland Wettlén, Eslöv, Sweden

[73] Assignee: Esselte Security Systems AB, Stockholm, Sweden

[21] Appl. No.: 665,348

[22] Filed: Oct. 26, 1984

[30] Foreign Application Priority Data

Oct. 26, 1983 [SE] Sweden ..... 8305886

[51] Int. Cl.[4] ..... B65H 5/00; B65H 5/12

[52] U.S. Cl. ..... 221/236; 221/259; 271/10; 271/139; 271/267

[58] Field of Search ..... 221/36, 43, 236, 259; 271/42, 131-144, 267, 119, 118, 10, 14, 84

[56] References Cited

U.S. PATENT DOCUMENTS

| | | | |
|---|---|---|---|
| 2,394,410 | 2/1946 | Tascher | 271/119 |
| 2,783,042 | 2/1957 | Picking | 271/42 |
| 3,220,605 | 11/1965 | Casey | 271/119 |
| 3,527,457 | 9/1970 | Schaller | 221/36 X |
| 4,013,283 | 3/1977 | Tress et al. | 271/263 X |
| 4,060,228 | 11/1977 | Tress et al. | 271/14 |
| 4,061,329 | 12/1977 | Sachuck et al. | 271/10 |
| 4,405,124 | 9/1983 | Watanabe | 271/138 |
| 4,557,472 | 12/1985 | Hannon | 271/138 |

FOREIGN PATENT DOCUMENTS

| | | | |
|---|---|---|---|
| 2023105 | 12/1979 | United Kingdom | 271/14 |

*Primary Examiner*—H. Grant Skaggs

*Assistant Examiner*—Gregory L. Huson

*Attorney, Agent, or Firm*—Nies, Webner, Kurz & Bergert

[57] ABSTRACT

A dispensing arrangement for dispensing planar lottery tickets and like articles comprises a chute which in cross-section corresponds to the surface configuration of a lottery ticket, and at one end of which there is arranged a dispensing mechanism intended for separating a lottery ticket lying nearest the mechanism through a slot-like opening. According to the invention, the dispensing mechanism includes a friction member (12) which can move in the dispening direction and which in a first position is located beneath or in the plane in which a lottery ticket located nearest the mechanism (12) is intended to lie, and which in the second position is located above this plane. In the second position of the friction member, the friction member (12) lifts the end of a lottery ticket opposite the slot-like opening, wherewith the lottery ticket is supported at three locations, namely against the friction member (12) and against two mutually spaced and mutually parallel support bars (9) or like members. The support bars (9,10) and a stop bar (21) located at right angles to each of the support bars define therebetween slot-like openings (18). A lottery ticket is fed out through the slot-like openings (18) by movement of the friction members (12) in the dispensing direction, while supporting the lottery ticket at the aforementioned three abutment locations, at least during the first stage of a dispensing operation.

5 Claims, 8 Drawing Figures

APPARATUS FOR DISPENSING TICKETS OR THE LIKE

The present invention relates to a dispensing arrangement for dispensing planar lottery tickets or the like.

More specifically, the invention relates to a dispensing arrangement incorporated in unattended automatic machines from which lottery tickets or other valuable documents can be purchased, and also in machines for dispensing banknotes and other articles. Notwithstanding this, however, the invention will be described hereinafter with reference to an automatic lottery dispenser.

There is today a great call for machines through which lottery tickets or the like can be purchased, by inserting thereinto a sum of money corresponding to the price of the articles offered for sale. One problem associated with machines of this kind, is that only one lottery ticket shall be dispensed at a time and that the dispensing function of the machine shall be troublefree, even when all tickets to be dispensed are not perfectly flat or have other minor defects. It is also essential that the ticket is guided during the whole of a dispensing sequence in a manner which will eliminate risk of the ticket being deformed during said sequence, such as to prevent further tickets being dispensed.

Various designs of such dispensing machines are known to the art. In one such machine, commonly in use, a gripping arm having shoulders or like promontories thereon is arranged to engage the trailing edge of the lowermost lottery ticket in a stack of such tickets, and move the tickets towards a receipt opening. One disadvantage inherent with such dispensers is that the edges of respective lottery tickets must be quite cleanly cut, without exhibiting any appreciable ragged portions or without being curled in an upward or downward direction, in order for the tickets to be dispensed correctly. If any lottery tickets are deficient in any of these respects, the gripping arm may not be able to grip the ticket edge correctly. For example, if the edges of the tickets bend downwards, the arm is liable to engage the two lowermost tickets in said stack, and to dispense these tickets together, since the height of the shoulders of the gripping arm is not much smaller than the thickness of a ticket.

Apparatus of this kind in which tickets are dispensed with the aid of shouldered feed arms, also have the disadvantage that the trailing edges of the tickets are readily deformed by said arms and that indentations are liable to be formed in the edges of the tickets, causing the arm to lose its grip thereon. In order to reduce the risk of deforming the trailing edges of such lottery tickets, the shoulders must be given a relatively large width in relation to the width of the planar tickets. In addition, during a dispensing operation the shoulders must move in line with the resting plane of the stack of tickets. Since such a mechanical function requires a broad gripping edge, it is necessary for the edges of the tickets to be straight. The tickets must also be flat, so that they are able to pass through a slot when displaced from their rest position.

These disadvantages are fully circumvented by means of the present invention, which provides a dispensing arrangement for automatic machines of the aforesaid kind which ensures that only one lottery ticket will be dispensed at a time, and with which slightly deformed tickets will also be dispensed reliably.

Thus, the invention relates to a dispenser for planar lottery tickets and the like which comprises a chute which in cross-section corresponds to the surface area of a lottery ticket and which incorporates at one end thereof a dispensing mechanism which is arranged to separate that ticket which lies closest to the mechanism through a slot-like opening, said dispenser being characterized in that the dispensing mechanism includes a friction member which is movable in the dispensing direction and which in a first position is located beneath or in the plane in which a lottery ticket located nearest the mechanism is intended to lie, and which in a second position is located above said plane, in which second position the friction member is intended to lift the end of a ticket remote from the slotlike opening, whereby the ticket is supported at three locations, namely against the friction member and against each of two mutually spaced and mutually parallel support bars or the like, between which support bars and a stop bar extending at right angles to each of said support bars slot-like openings are formed, said ticket being dispensed through said slot-like openings upon movement of the friction member in the dispensing direction, while supporting said ticket at said three locations during at least the first phase of a dispensing operation.

The invention will now be described in more detail with reference to embodiments thereof illustrated in the accompanying drawings, in which FIG. 1 is a schematic side view of a first embodiment of a dispensing arrangement;

Figure 4A:
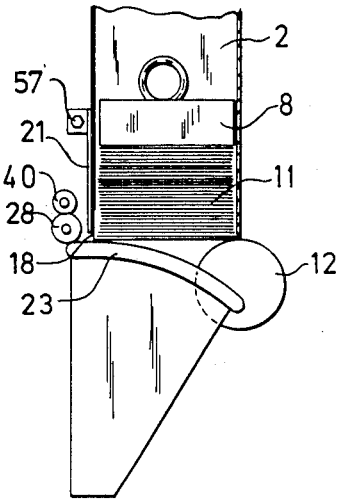
Figure 4B:
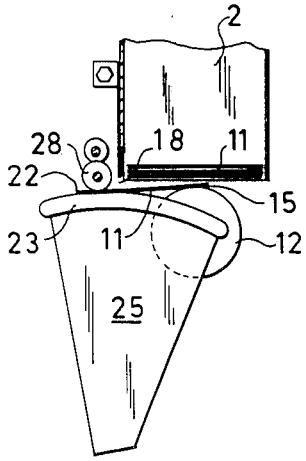
Figure 4C:
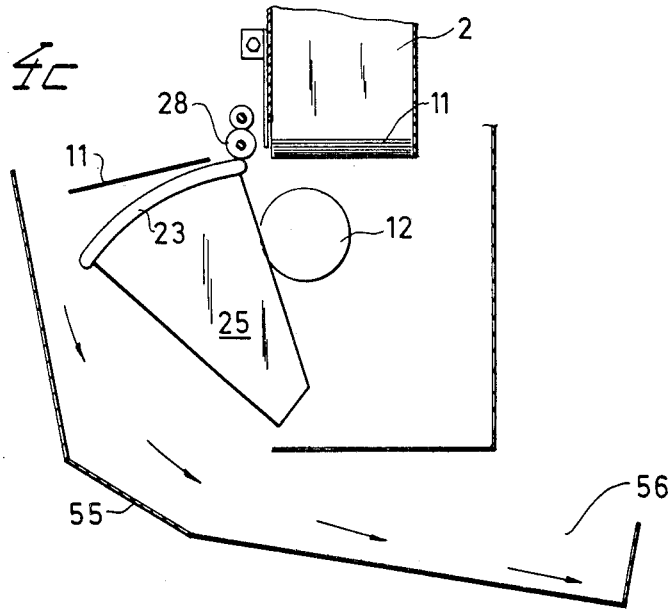
Figure 5:
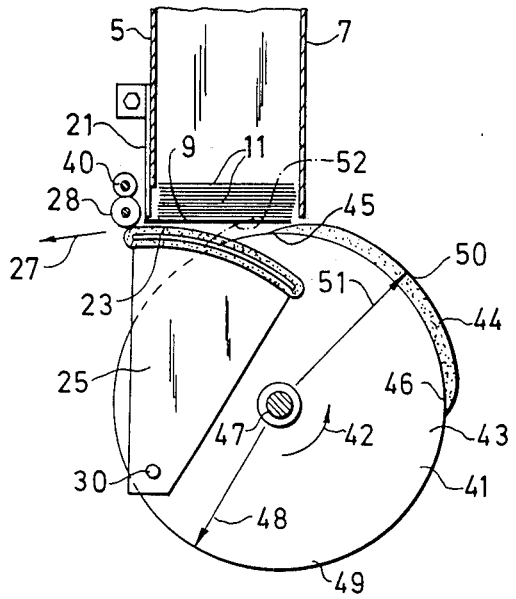
Figure 6:
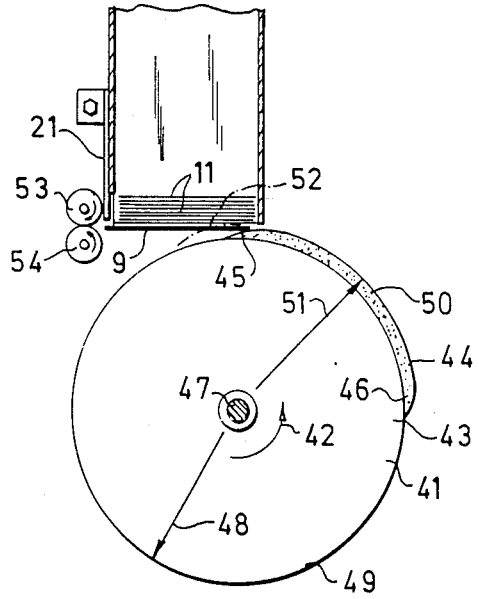

FIGS. 4*a*–4*c* illustrate various stages in a ticket dispensing operation, in which the dispensing arrangement is shown very schematically;

FIG. 5 illustrates schematically a second embodiment of a dispensing arrangement according to the invention; and FIG. 6 illustrates schematically a third embodiment of a dispensing arrangement according to the invention.

Figure 1:
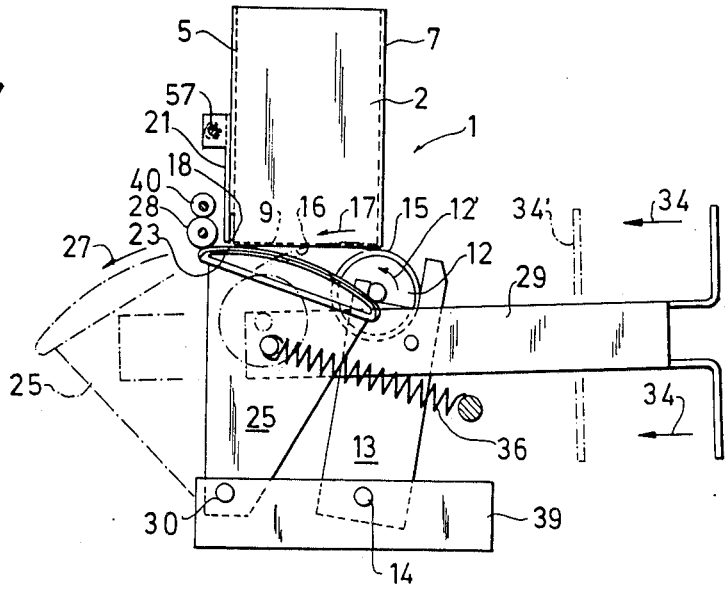

FIG. 1 is a schematic sideview of a dispensing arrangement, generally shown at 1, for issuing planar lottery tickets or like documents.

The arrangement 1 comprises a chute 2 which in cross-section corresponds approximately to the surface area or shape of a lottery ticket and which is formed of a number of vertical walls 3–7. The chute 2 is intended to receive a stack of, for example 500, planar lottery tickets, i.e. tickets which are mutually separate from one another and flat. As shown in FIG. 4*a*, a weight 8 is provided to ensure that the tickets move successively downwards in the chute 2, and also to ensure that when only a few tickets remain, the lowermost ticket lies against support bars 9,10 located at the lower end of the chute. In FIGS. 3, 4a –4c, 5 and 6 there is illustrated schematically piles or stacks of lottery tickets 11 in which the tickets are shown in slightly spaced, superimposed relationship for the sake of clarity. As will be understood, the physical weight 8 can be replaced with a spring means, which is to be preferred when the chute extends in a direction other than vertical.

Arranged at the lower end of the chute 2 is a dispensing mechanism which is arranged to separate that ticket located nearest the mechanism from the remaining tickets in the stack.

The dispensing mechanism includes a friction member, which is arranged for movement in the dispensing direction. According to a first embodiment, illustrated in Figures 1 and 2, the friction member has the form of a roller 12 which can rotate in one direction only and which is journalled on a pivot arm 13. The length of the pivot arm 13 and the position of its centre of rotation 14 are so chosen that the peripheral portion 15 of the roller 13 located furthest from said centre of rotation is movable along a circular arc 16 in the direction of arrow 17, between a first and a second position.

Figure 2:
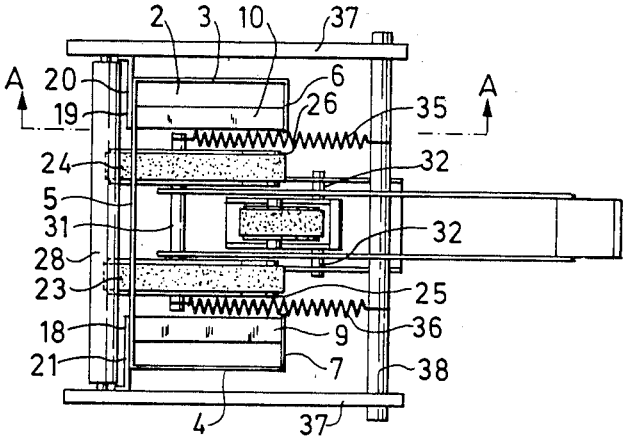
FIG. 2 is a schematic top plan view of the dispensing arrangement illustrated in FIG. 1.
Figure 3:
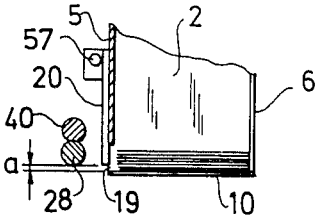
FIG. 3 is a sectional view of a detail of the arrangement shown in FIG. 2, taken on the line A—A in said Figure.

In the first position, shown in full lines in FIG. 1, the roller 12 is located beneath or in the plane in which the lowermost lottery is intended to lie. This plane coincides with the upper surfaces of the support bars 9,10. When occupying its second position, the peripheral portion 15 of the roller lies above said plate. As shown in FIG. 1, the arc 16 approximately beneath the arrow 17 in the Figure, lies slightly above the upper surface of the support bar 9. Further movement of the roller in the direction of arrow 17 will cause the peripheral portion 15 of the roller 12 again to move to a position beneath the aforesaid plane, as illustrated in phantom lines in FIG. 1. As shown, inter alia, in FIGS. 1 and 3, located at the foreward lower part of the chute 2 are two slot-like openings 18,19. In FIG. 2, the position of the openings is indicated by references 18,19.

The slot-like openings 18,19 are each formed between the upper surfaces of respective support bars 9,10 and a stop bar 20,21 extending at right angles to each of said support bars. The stop bars 20,21 are displaceable arranged for movement towards and away from respective support bars 9,10, to enable the height a of the gaps to be adjusted, see FIG. 3. A locking screw 57 is provided for holding the stop bars in position. The gap height a shall be slightly greater than the thickness of a lottery ticket but slightly smaller than the double thickness of a ticket. The thickness of a lottery ticket can vary between, for example, 0.2 and 0.7 mm. In the case of a ticket having a thickness of 0.2 mm, the gap height a should be about 0.3 mm. When the ticket thickness is 0.7 mm, the gap height a may be, for example, 1.0 mm.

Thus, in its starting position, the friction member, i.e. the roller 12 in this embodiment, occupies the aforesaid first position. When the pivot arm 13 is moved a short distance to the left in FIG. 1, the roller takes its second position, in which said roller lifts the end of a lottery ticket opposite the slot-like openings 18,19. At this stage, the ticket is supported at three locations, namely against the roller 12 and against each of the support bars 9,10. Abutment against the support bars takes place at the slot-like openings 18,19. By lifting the lottery ticket in the aforesaid manner, it is ensured that the leading edge of the ticket, seen in the feed direction, abuts the two support bars at the slot-like openings. The weight of the remaining lottery tickets and the force exerted by the weight 8 also ensure that the ticket lies over the whole width of the support bars 9,10, since said bars have a width which is much smaller than the width of the leading edge of the ticket.

Thus, in this position the ticket is fixed in relation to the slot-like openings. By arranging slot-like openings 18,19, having a width which corresponds solely to the width of the support bars 9,10, the ticket can be permitted to bend downwards slightly between the support bars 9,10, without impairing the dispensing function.

Should the ticket have a slightly downwardly-folded leading edge, or a leading edge which has been poorely cut and exhibits burrs, these irregularities on the ticket are smoothed out at the abutment locations of the ticket against the support bars. In order to ensure reliable feed-out of lottery tickets with which the corners thereof are folded down slightly, for example as the result of rough handling when stacking said tickets, the support bars, in accordance with a preferred embodiment, are spaced apart at a distance which is shorter than the dimension of a lottery ticket transversely to the dispensing direction, such that the support bars 9,10 and the gaps 18,19 are located at a short distance from the short sides of the ticket. A slightly downwardly folded corner, or damaged corner, will then pass outside the slots 18,19.

The roller 12 preferably engages the undersurface of a lottery ticket at a location slightly inwardly thereof, thus not directly at its trailing edge. In this respect, the roller 12 when occupying its second position, i.e. the position at which a ticket is lifted, is located at a distance from the slot-like openings, which is smaller than the dimension of the tickets in the dispensing direction. The reason for this is that the buckle length of the ticket, i.e. the length from the point of engagement of the roller 12 to the leading edge of said ticket is then smaller and the buckle force therewith greater than is the case when the location of engagement of the roller is in the close proximity of the trailing edge of the ticket.

Thus, when the roller 12 is moved forwards in the direction of arrow 17, the leading edge of a lottery ticket is fed through the slot-like openings 18,19, while the ticket is supported at the aforesaid three locations, at least during the first phase of a dispensing operation.

FIG. 4*a* illustrates the starting stage when a ticket 11 is to be dispensed through the slot-like openings 18,19. FIG. 4*b* illustrates the roller in its second position, i.e. a position in which the peripheral portion 15 of the roller is located above said plane. FIG. 4*b* illustrates a position in which the leading edge 22 of the ticket 11 has already passed through the slot-like openings. As will be clearly seen from FIG. 1 and Figure 4*b*, when the roller 12 is moved further forward by the pivot arm 13, the roller will again be located beneath said plane before the ticket has been fully dispensed.

For the purpose of carrying the second dispensing phase into effect, during which phase dispensing of the ticket is completed, there is provided a strip-like friction member 23, 24 which extends parallel with the dispensing direction between the roller 12 and each of the support bars 9,10. Each of the friction strips 23,24 is carried by a respective pivot arm 25,26, arranged to swing in a plane parallel with the dispensing direction 17,27. The friction strips 23,24 have a length which is greater than the dimension of a lottery ticket in the dispensing direction. In their starting positions, the friction strips 23,24 are moved to the right to the position shown in full lines in FIG. 1, in which position the leading parts of the friction strips lie against a roller 28 located outside the slot-like openings 18,19 seen in the dispensing direction.

Upon movement of the friction strips, caused by movement of the pivot arms 25,26, from the position shown, in full lines in FIG. 1 to the position shown in phantom lines therein, a lottery ticket fed into the slot between the friction strips 23,24 and the roller 28 will be dispensed to a position externally of the roller 28, see FIG. 4*c*.

In order to cause a ticket which has passed through the slot-like openings 18,19 to pass in between the friction strips and the roller, movement of the friction strips 23,24 in the dispensing direction is synchronized with the movement of the roller 12 in said dispensing direction.

In accordance with a preferred embodiment, to this end the pivot arms 25, 26, of the friction strips 23,24 and the pivot arm 13 of the roller 12 are connected together by an auxiliary arm 29, which extends between a line passing through the pivot points 30; 14 of the pivot arms 23,24; 13 and the aforesaid plane, or support bars 9. All pivot arms are suitably journalled in a common U-shaped member 39. The auxiliary, or operating arm 29 is connected to the pivot arms 25,26 of the friction strips and to the pivot arm 13 of the roller 12 by means of shafts 31 and 32,33 respectively.

By moving the operating arm 29 in the direction of the arrows 34 to the position 34' shown in phantom lines in FIG. 1, the roller 12 and the friction strips 23,24 will be displaced through the distance required to completely dispense a ticket. For the purpose of ensuring that the roller 28 abuts the friction strips 23,24, there is suitably provided a springloaded roller 40, which lies against the roller 28. The roller 40 is not shown in FIG. 2.

The movable elements are moved from the position illustrated in FIG. 4c back to the starting position illustrated in FIG. 1. The roller 12 can be rotated in the direction of arrow 12', and hence the roller will partially roll against the undersurface of the lowermost ticket 11 during movement of the roller back to its starting position The operating arm preferably comprises a machine element which is intended for manual manipulation and which can be released by a latching mechanism (not shown) upon insertion of a sum of money corresponding to the price of a lottery ticket, whereafter said operating arm is again latched against further movement until further money is inserted This forward and backward movement, however, can also be effected by means of an electromagnetic device. For the purpose of facilitating the return of the mechanism to the starting position, two springs 35,36 are connected between the shaft 31 and a pin 38 attached to the chassis 37 of the arrangement.

The friction strips 23,24 and the roller 12 act against a lottery ticket. FIG. 4c illustrates the friction strips 23,24 in their outer terminal position, in which the ticket 11 has been separated.

The frictions strips 23,24 suitably comprise rubber bands, supported on a circular arcuate section of each of the pivot arms 25,26.

The roller 12 suitably comprises a roller carrying a rubber band.

In FIG. 4c there is schematically illustrated a transport chute 55, for transporting a lottery ticket dispensed by the dispensing mechanism to the receiver The direction in which the ticket is transported is shown by the arrows. A pocket 56 is accessible to the receiver. On the other hand, it is impossible, or in any case difficult, for a person to reach the stack of lottery tickets through the transport chute 55.

FIGS. 1 and 2 illustrate a first embodiment.

FIGS. 5 and 6 illustrate a second embodiment of the friction member.

According to this second embodiment the friction member comprises a wheel 41, which can be rotated in the direction of the arrow 42, for example by means of an electric motor. The radius of the wheel 41 varies around its circumference. The wheel 41 may comprise a metal wheel 43 carrying around a given section of its circumference a friction portion 44, such as a rubber element, whereby the radius of the wheel is greater at the location of said section. The ends 45, 46 of the applied friction portion 44 are preferably chamfered, so as to successively adapt to the radius of the metal wheel 43.

The rotation axis 47 of the wheel 41 is located beneath the aforesaid plane, which in FIGS. 5 and 6 is schematically denoted by the upper surface of the support bar 9. The radius 48 of the wheel 41 is smaller along a circumferential section 49 than the distance between the rotary axis 47 and said plane. The radius 51 from said rotary axis to the other circumferential section 50 is greater than the distance between said rotary axis 47 and said plane.

When the wheel 41 is located in the position illustrated in FIG. 5 and is rotated in the direction of arrow 42, the outer surface of the friction portion 44 will be located at the position of the phantom line 52 subsequent to rotation of said wheel through a given distance, wherewith the friction portion of the wheel 41 will engage the lottery ticket lying nearest the wheel, this lottery ticket being lifted to the aforementioned three- location abutment position, whereupon dispensing of the ticket is commenced. The wheel is rotated until it has completed a full revolution. Consequently, the wheel 41 together with its friction portion 44 has the same or a similar effect on the lottery ticket as the aforedescribed roller 12.

Final dispensation of the lottery ticket can be effected by an arrangement of the kind aforedescribed comprising pivot arms 25,26 with friction strips 24,25, and the roller 28. The reciprocating movement of the pivot arms can be effected by causing the pivot arms 25, 26 to abut and follow a camming curve mounted on the shaft of the wheel 41.

An alternative arrangement for effecting the final stages of a dispensing operation is illustrated in FIG. 6. The first phase of a ticket dispensing operation is effected in the manner just described. In this embodiment, however, the final stage of the dispensing operation is effected by means of two rollers 53,54 coated with a friction-enhancing material, which replace the roller 28 and the friction strips 25,26 and which are motor driven. The rollers 53,54 are driven until a lottery ticket has been fully dispensed.

As beforementioned, the present invention solves the difficulties mentioned in the introduction and provides a simple dispensing mechanism which, despite its simple constructions, ensures that only one lottery ticket at a time is dispensed, and the function of which is not impaired by minor defects on the lottery tickets, such as slightly downwardly folded edges, poorly clipped edges, or slightly crumpled corners.

It will be understood to one of normal skill in this art that modifications can be made to the described and illustrated embodiments without departing from the concept of the invention.

The invention is therefore not limited to the described embodiments, and modifications can be made within the scope of the following claims.

We claim:

1. A dispensing arrangement for dispensing planar tickets or the like, comprising a chute, the cross-section of which corresponds to the surface configuration of the ticket and at one end of which there is located a dispensing mechanism arranged to separate a ticket located nearest the mechanism through a slot-like opening, characterized in that the dispensing mechanism comprises a rotatable friction means (12;41) which is mounted for movement in the dispensing direction and which in a first position is located beneath a position above the plane in which a ticket located nearest the mechanism (12; 41) is intended to lie, and which in a second position is located above said plane, in which second positioin the rotatable friction means (12; 41) is arranged to lift the end of a ticket opposite the slot-like opening, said ticket being supported at three locations, namely against the rotatable friction means (12; 41), and against two mutually spaced and mutually parallel support bars (9, 10) or like members, between which support bars (9, 10) and stop bar means (20, 21) extending at right angles to each of said support bars provide slot-like openings (18, 19) between associated said support bars and stop bar means, said ticket being dispensed through the slot-like openings (18, 19) upon movement of the rotatable friction means (12; 41) in the dispensing direction while the ticket is being supported at said three abutment locations during at least the first dispensing phase of a dispensing operation; said dispensing arrangement including strip-like friction members (23, 24) located parallel with the dispensing direction (17) between said rotatable friction means and each of said support bars (9, 10), said friction members (23, 24) each being carried by first pivot arms (25, 26) arranged to swing in an arcuate plane parallel with the dispensing direction; and further characterized in that the friction members (23, 24) have a length which exceeds the dimension of a ticket as measured in said dispensing direction (17); and in that said friction members lie against a roller (28) located outside said slot-like openings (18, 19) seen in the dispensing direction, wherewith upon movement of the friction members (23, 24), caused by pivotal mvoement of the pivot arms (25, 26), a ticket fed into the gap between the friction members (23, 24) and the roller (28) by means of said rotatable friction means is dispensed to a position externally of said roller (28).

2. A dispensing arrangement according to claim 1. characterized in that the rotatable friction means comprises a rotatable wheel (41) whose radius varies around its circumference and the rotary axis (47) of which wheel is located beneath said plane and a first radius (48) of which from said rotary axis to a first circumferential section (49) is shorter than the distance between said rotary axis (47) and said plane, and a second radius (51) of which from said rotary axis to a second circumferential section (50) of said wheel is greater than said distance.

3. A dispensing arrangement according to claim 1, characterized in that the rotatable friction means (12; 41) when occupying said second position is located at a distance from said slot-like openings (18,19) which is shorter than the dimension of a ticket in the dispensing direction (17).

4. A dispensing arrangement according to claim 1, characterized in that the rotatable friction means comprises a roller (12) which is able to rotate in only one direction and which is journalled on a second pivot are (13), the length of which and the rotary axis (14) of which are so chosen that the peripheral part (15) of the roller means (12) furthest from said rotary axis (14) can move along a circular arc (16) from said first position relative to said plane to said second position above said plane.

5. A dispensing arrangement according to claim 4, characterized in that the first pivot arms (25,26) of said friction members (23,24) and the second pivot arm (13) of said roller member (12) are mutually connected by an operating are (29) projecting along a path which is between a line passing through the rotary axes (30; 14) of said first and second pivot arms and the aforesaid first mentioned plane, by means of which operating are (29) the requisite pivotal movement of the first pivot arms (25,26;) are effected by manual manipulation of the operating arm (29).

* * * * *